United States Patent [19]

Alliot et al.

[11] 3,961,995

[45] June 8, 1976

[54] MOTHER ALLOY OF ALUMINUM, TITANIUM AND BORON AND PROCESS FOR FABRICATION

[75] Inventors: Maurice Alliot, Modane, France; Jean-Claude Beguin, Brussels, Belgium; Michel Moutach, Vizille; Jean-Claude Percheron, Chedde, both of France

[73] Assignee: Aluminum Pechiney, Lyon, France

[22] Filed: Apr. 1, 1974

[21] Appl. No.: 456,672

[30] Foreign Application Priority Data

Apr. 4, 1973 Luxemburg ..... 67355

[52] U.S. Cl. ..... 148/32; 75/.5 R; 75/.5 C; 75/68 R; 75/138

[51] Int. Cl.[2] ..... C22C 21/00

[58] Field of Search ..... 75/138, 68 R, 5 R, 5 C; 148/32, 32.5

[56] References Cited

UNITED STATES PATENTS

| | | | |
|---|---|---|---|
| 2,578,098 | 12/1951 | Southard | 75/138 |
| 3,464,816 | 9/1969 | Biddulph | 75/138 |
| 3,785,807 | 1/1974 | Backerud | 75/138 |

*Primary Examiner*—R. Dean

*Attorney, Agent, or Firm*—McDougall, Hersh & Scott

[57] ABSTRACT

An aluminum-titanium-boron mother alloy having a boron content of 0.2 to 0.8% by weight and a titanium content such that Ti - 2.2 B $\geqslant$ 3.9%, in which the matrix has a preponderant proportion of grains of less than 30 microns in size, and contains fine $TiB_2$ crystals having an average size of about 1 micron primarily dispersed along the grain boundaries, and the method for the preparation of same by the formation of titanium diboride by the action of liquid aluminum on titanium oxide and boron oxide in solution in molten cryolite, mixing the reactants in a manner to utilize the starting materials, and then quenching the formed alloy rapidly to cool and solidify the mother alloy, preferably by pouring the liquid alloy in water to produce the alloy in the form of granules or fine powder.

7 Claims, No Drawings

MOTHER ALLOY OF ALUMINUM, TITANIUM AND BORON AND PROCESS FOR FABRICATION

This invention relates to aluminum-based alloys containing titanium and boron intended for the grain refinement of aluminum alloys, and to a process for their production.

The properties of titanium and boron, in regard to grain refinement, have been known for some time, as has the process for introducing these elements by means of mother alloys (cf. French Patent Specification No. 932,575).

However, certain difficulties are involved in processing mother alloys of this kind, and the results obtained in regard to grain refinement differ very appreciably, according to the composition of the alloy and its method of preparation.

In the process described in French Patent Specification No. 2,133,439, two aluminum masses, one containing dissolved titanium and the other dissolved boron, are contacted at elevated temperature (above 1000°C), resulting in the formation of titanium diboride crystals which are insoluble in the aluminum. The mixture then has to be intensively cooled in order to avoid growth of the $TiB_2$ crystals, which reduces the effectiveness of the mother alloy.

Accordingly, mixing of the two molten masses and cooling have to be carried out at virtually the same time, which necessitates expensive apparatus, both for mixing and for cooling, so that it is only possible to use very small batches at a time.

In another process, described in French Patent Specification No. 1,264,974, a fluotitanate and an alkali fluoborate are reduced with molten aluminum. Although this process gives mother liquors of suitable quality, the fluo salts are extremely expensive products, in addition to which they decompose at relatively low temperatures, 750°C in the case of the fluoborate, to form boron fluoride which volatilizes. Apart from the losses of boron which this involves, the toxicity of $BF_3$ requires an elaborate recovery installation which increases the cost price of the product.

The present invention relates to mother alloys which can be used with excellent results while, at the same time, being easier and less complicated to obtain than conventional mother alloys.

The mother alloy according to the invention contains from 0.2% to 0.8% by weight of boron, while its titanium content is defined by the relation $Ti - 2.2\ B \geqslant 3.9\%$. It comprises a matrix with a preponderant proportion of grains less than 30 microns in size and $TiB_2$ crystals with an average grain size of less than 1 micron, largely dispersed along the grain boundaries of the matrix.

It is preferably in the form of a granulate which is particularly convenient to use.

The process for obtaining the alloy according to the invention comprises three stages:

1. formation of titanium diboride by the action of liquid aluminum on titanium oxide and boron oxide in solution in molten cryolite ($AlF_3.3NaF$);

2. mixing the reactants in such a way that the starting materials are fully utilized;

3. quenching the mother alloy obtained by very rapid cooling, advantageously by pouring the liquid metal into water, which enables granulate to be obtained.

The first stage is itself preferably divided into the following stages:

1*a* preparing a bath of aluminum at an elevated temperature above 1050°C and a solution of titanium dioxide in cryolite at a substantially identical temperature;

1*b* contacting the two liquid masses; and

1*c* introducing boron oxide into the mixture.

The weights of aluminum, $TiO_2$ and $B_2O_3$ are preferably selected in such a way that the mother alloy contains $$0.2 \leqslant B \leqslant 0.8 \text{ by weight and}$$

$$Ti - 2.2\ B \geqslant 3.9\% \text{ by weight}$$

It has been found that a boron content of less than 0.2% reduces the effectiveness of the mother alloy, while a content of greater than 0.8% merely increases the cost of the mother alloy without in any way increasing its effectiveness. The criterion governing the titanium content corresponds to the fact that it has been found that a minimal content of titanium, uncombined with the boron, further improves effectiveness. The titanium, uncombined with boron, is present in the alloy above all in the form of titanium aluminide, which crystallizes in the form of needles which show up in micrographs.

The process, in which aluminum is reacted with a refractory metal oxide in solution in cryolite, has already been described, notably in British Patent Specification No. 915,693, although the titanium diboride formed could have been expected to have been affected by the phenomenon referred to in French Patent Specification No. 2,133,439 mentioned above, namely rapid growth of the crystals, which would have necessitated intensive cooling immediately after the beginning of the reaction. It has surprisingly been found that this is in fact not the case, and that the formed $TiB_2$ crystals with an average size of around 1 micron, do not grow in the liquid bath and retain their dimensions even after one week's residence at elevated temperature. Accordingly, the aluminum and the cryolite can be kept in contact for as long as is necessary to exhaust the cryolite. In practice, the two liquids are preferably contacted by the transfer method. Initially, the temperature of the bath rises to 1300° to 1500°C because the reaction is exothermic, and then falls again when the cryolite is exhausted. The reaction can be considered to be over when the temperature reaches approximately 900°C.

The metal can then be cast into an ingot mold.

Microscopic examination of the mother alloy, thus obtained, shows a matrix consisting of aluminum crystallized into grains of 50 to 300 microns and more in size, which is traversed by acicular crystals of titanium aluminide, and in which most of the $TiB_2$ grains, with a size of around 1 micron, are distributed along the grain boundaries where they form accumulations.

If, in accordance with the process of the invention, the mother alloy is solidified by cooling in such a way that the size of the grains of the matrix does not exceed 30 microns, the $TiB_2$ crystals are present in highly dispersed form, on the one hand because the grain boundaries are more numerous and, on the other hand because some of the $TiB_2$ crystals are actually dispersed inside the grains.

Comparison of the results obtained by introducing into aluminum mother alloy, where the $TiB_2$ is dispersed, and mother alloy cast into ingots in the usual way, shows that the dispersion multiplies the effectiveness of the alloy by a factor of about 1.5.

In order to carry out cooling in such a way that the size of the grains of the matrix does not exceed 30 microns, the most simple method is to pour the liquid metal into water. It is also possible to project the liquid metal in a jet of compressed air. This results in the formation of granules or fine powder which, in addition, are particularly convenient to use and which mix readily with the metal to be treated.

It is surprising and had not been expected that the $TiB_2$ crystals, which are subsequently used as seed crystals, should be distributed along the grain boundaries, rather than at the center of the crystals, as expected. This fact combined with the equally surprising observation that they do not undergo any dimensional changes in the liquid bath, would seem to imply (although this is purely an explanatory and by no means a restrictive hypothesis) that their method of formation provides the $TiB_2$ crystals with physicochemical surface properties which inhibit their reaction with the aluminum. These properties disappear in a more dilute medium, leaving the known grain-refining properties to reappear.

We claim:

1. An aluminum-titanium-boron mother alloy consisting essentially of a boron content of 0.2 to 0.8% by weight and a titanium content such that $Ti - 2.2\ B \geq 3.9\%$, balance aluminum, wherein the aluminum matrix comprises a preponderant proportion of grains less than 30 microns in size, and wherein it contains fine $TiB_2$ crystals having an average size of about 1 micron in highly dispersed form along the grain boundaries of the aluminum matrix.

2. A mother alloy as claimed in claim 1 in the form of granules or fine powder.

3. A process for producing the aluminum-titanium-boron mother alloy claimed in claim 1, comprising the following stages:

formation of titanium diboride by reacting liquid aluminum with titanium oxide and boron oxide in solution in molten cryolite;

quenching the aluminum-titanium-boron alloy rapidly to cool and solubilize the reaction product.

4. A process as claimed in claim 3 wherein a bath of molten aluminum and a solution of titanium dioxide in cryolite are initially prepared, followed by the addition of boron oxide to the cryolite after the molten aluminum and the titanium oxide solution have been brought into contact.

5. A process as claimed in claim 3, wherein the aluminum and the cryolite are at a temperature of at least 1050°C when they are contacted.

6. A process as claimed in claim 5 wherein the reaction is completed when the temperature, after having risen, has fallen to 900°C.

7. A process for producing a mother alloy as claimed in claim 3, wherein the aluminum-titanium-boron alloy is poured into water for quenching.

* * * * *